US005222346A

United States Patent [19]

Wegscheider et al.

[11] Patent Number: 5,222,346

[45] Date of Patent: Jun. 29, 1993

[54] PROCESS AND DEVICE FOR PACKING A SUBSTANCE IN A FOIL TUBE

[75] Inventors: Jürgen Wegscheider, Isny/Allgau; Franz Hartmann, Simmerberg; Konrad Hauber, Lindenberg, all of Fed. Rep. of Germany

[73] Assignee: Natec, Reich, Summer GmbH & Co. Kg., Openbach, Fed. Rep. of Germany

[21] Appl. No.: 848,021

[22] Filed: Mar. 9, 1992

[30] Foreign Application Priority Data

Feb. 14, 1992 [DE] Fed. Rep. of Germany ..... 4204396

[51] Int. Cl.[5] ..... B65B 9/02; B65B 61/24

[52] U.S. Cl. ..... 53/440; 53/127; 53/450; 53/552

[58] Field of Search ..... 426/396, 395, 394, 113, 426/412; 53/440, 450, 451, 550, 551, 552

[56] References Cited

U.S. PATENT DOCUMENTS

| | | | |
|---|---|---|---|
| 1,546,963 | 7/1925 | Biernbaum . | |
| 2,133,348 | 10/1938 | Ferenci | 93/2 |
| 2,156,466 | 5/1939 | Vogt | 93/3 |
| 2,505,603 | 4/1950 | Brandenberger | 99/171 |
| 2,759,308 | 8/1956 | Nawrocki | 53/122 |
| 3,300,944 | 1/1967 | Thesing | 53/28 |
| 3,325,961 | 6/1967 | Lindh et al. | 53/28 |
| 3,378,988 | 4/1968 | McClosky | 53/180 |
| 3,388,525 | 6/1968 | Thesing et al. | 53/39 |
| 3,469,363 | 9/1969 | Berckmoes | 53/440 |
| 3,634,099 | 1/1972 | Wilson | 53/440 X |
| 4,199,919 | 4/1980 | Moscatelli | 53/552 |
| 4,426,401 | 1/1984 | Ottow et al. | 53/440 X |
| 4,506,494 | 3/1985 | Shimoyana et al. | 53/551 |
| 4,524,567 | 6/1985 | Patelli | 53/552 |
| 4,543,769 | 10/1985 | Schmitz | 53/450 |
| 4,759,170 | 6/1988 | Sawa et al. | 53/551 |
| 4,949,846 | 8/1990 | Lakey | 206/484 |
| 5,112,632 | 5/1992 | Meli et al. | 426/392 |

FOREIGN PATENT DOCUMENTS

| | | |
|---|---|---|
| 0138044 | 4/1985 | European Pat. Off. . |
| 1027124 | 3/1958 | Fed. Rep. of Germany . |
| 1124865 | 3/1962 | Fed. Rep. of Germany . |
| 35551 | 11/1965 | Fed. Rep. of Germany . |
| 1611891 | 10/1969 | Fed. Rep. of Germany . |
| 1586328 | 1/1971 | Fed. Rep. of Germany . |
| 2259121 | 6/1973 | Fed. Rep. of Germany . |
| 2622393 | 8/1978 | Fed. Rep. of Germany . |
| 3621556 | 4/1987 | Fed. Rep. of Germany . |
| 3841056 | 6/1989 | Fed. Rep. of Germany . |
| 3841945 | 7/1989 | Fed. Rep. of Germany . |
| 94157 | 2/1959 | Norway . |
| 587751 | 5/1977 | Switzerland . |
| 709966 | 6/1954 | United Kingdom . |
| 1004097 | 9/1965 | United Kingdom . |

OTHER PUBLICATIONS

U.S. Ser. No. 07/848,371, Mar. 1992, Hartmann.

*Primary Examiner*—James F. Coan

*Attorney, Agent, or Firm*—Brown, Martin, Haller & McClain

[57] ABSTRACT

A process for packing a liquid, semi-liquid, soft or fine-powder product in a closed foil tube, whereby the product is introduced into the foil tube in the area of a tube form station and taken to an expulsion station which expels the product from web-like expulsion areas extending over the width of the foil tube, and adds sealing seams to the foil tube in these areas. In order to achieve proper expulsion and sealing which is simple and tight using narrow sealing seams, the foil must first be cooled off prior to expulsion.

7 Claims, 4 Drawing Sheets

PROCESS AND DEVICE FOR PACKING A SUBSTANCE IN A FOIL TUBE

BACKGROUND OF THE INVENTION

The invention is a process and a device for packaging a liquid, semi-liquid, soft or fine-powder product in a closed foil tube in accordance with the introduction to Patent claim 1.

A process mentioned earlier has for example been published in DE 38 41 056 and 38 41 945 whose object is that in particular a meltable cheese mass is poured into a fully closed foil tube, and that corresponding form webs arranged on a conveyer form successive sections out of the foil tube closed with the cheese mass. In the area of these separating webs the meltable cheese mass is expelled from the foil tube, and the foil tube is then sealed and cooled off in this area. After cooling, the individual slices still coherent in the tube are then cut and taken to a stacking device.

In the above-named process the separation of the individual sections in the foil tube takes place in a hot state. This has the disadvantage that the foil changes in its linear expansion due to the heat impact from the hot mass thus resulting in changes in length in the foil in the area between filling the hot mass and the subsequent sealing station. This requires a relatively wide sealing seam in order to obtain sealing of the individual foil sections, i.e. to guarantee a sufficiently accurate sealing quality. Indeed, in order to accommodate the various changes in foil length, the sealing seam must be wide in order to guarantee sealing in the separated web area of the foil even under extreme changes in length.

However, when using relatively wide sealing seams of for example 16 mm it is not easy to realize a complete and clean expulsion of the hot mass from the sealing area thus affecting sealing quality. The risk was that the sealing seam would be soiled by product residue and that it would not be closed properly. In other words, no gas-tight seal could be guaranteed and the foodstuff contained in the foil tube would spoil more readily.

In addition, the application of relatively wide sealing seams had the disadvantage of a relatively high foil consumption, which translates into additional expenses of up to DM 50,000.00 per year with traditional production equipment and a normal production capacity. In addition, the foil used in the process was significantly more costly because sealing of this type required the use of a heat-resistant foil capable of withstanding the relatively high temperatures of the hot foodstuff of 80°–90° C. for example without showing any excessive non-permissible deformation.

In addition, the use of wide sealing seams shows that a so-called "foil tail" appears on the front ends of the individually cut packages and that it may turn out longer or shorter, thus affecting the subsequent stacking of individual packages.

SUMMARY OF THE INVENTION

The underlying task of the invention is to further develop a process of the type described above and a device performing the process so as to guarantee a low foil consumption with equal production capacity and so as to obtain geometrically exact stacks with the individual slices made and packed with this process.

This task is solved by a process in accordance with the present invention whereby the heated product is first poured into a foil tube and then cooled off until it assumes a pasty state, and whereby the product in this condition is expelled into individual sections in the foil tube and shortly thereafter is sealed.

In other words, an essential feature of the present invention is that the expulsion, i.e. the division of the foil tube in individual sections, no longer takes place when the product is hot but that this product-filled foil tube is first cooled off until the product has reached at least a pasty state and that the foil tube is expelled in this condition, i.e. divided in individual sections, and the separated sections sealed.

This results in significant advantages over the existing technology.

A first advantage is that as a result of dividing the foil tube, whereby the product is in a pasty state, form changes in the foil tube are no longer to be feared.

Using the process of existing technology as mentioned earlier, the foil tube bulged and deformed when the hot food product was poured whereby the newly created individual packages were deformed thus affecting the stacking capability of individual slices.

In contrast, the present invention offers the advantage that when the product is separated in a pasty state, such form changes no longer take place in the foil tube and that the product in the foil tube no longer bulges but is relatively flat. In other words, the thickness is uniform.

A further development of the present invention offers the advantage that after the hot-pouring of the food product into the foil tube the foil tube during cooling can be formed so that the product in the foil tube can already be formed flat whereby the preformed foil tube is then taken to the expulsion station mentioned.

This was not possible with existing technology because the hot food product was introduced into the foil tube and then immediately expelled and sealed, whereby it was no longer possible to affect the form of this product in this foil tube. The present invention however makes this possible.

In other words, the possibility of "cold expulsion" in accordance with the process of this invention offers the advantage that there is no longer the danger of the product running in the area of the foil tube when the individual sections are formed and running into the subsequent sealing seam but that there is no running danger because the product is only pasty and that therefore even narrow sealing seams can be applied, which presents significant advantages. In accordance with the above introductory description, narrow sealing seams offer the advantage of a lower foil consumption and the further advantage that the "foil tails" can now be cut off exactly thus guaranteeing exact stacking.

In addition, sealing seams are guaranteed tight even with narrow sealing seams because there is no longer the danger of the product running into the area of the sealing seam.

Another advantage is the fact that now an inexpensive recyclable foil can be used, e.g. a PB foil or a PE foil, which was not possible with existing technology because sealing was done in a hot state, while sealing is carried out in a cold state according to this invention.

The application of the present process using a device in accordance with the invention offers the further advantage the sealing station is arranged closely behind the expulsion station which eliminates the danger of a deformation of the expelled mass taking place in the foil tube and capable of affecting the subsequent sealing quality and accuracy.

However, the scope of application of the present invention is not only the sealing of hot meltable food products such as cheese but the scope of application of the present invention is the processing of any food products such as dough, peanut butter and such. Also, it is not necessary to pour a hot product into the foil tube but there are also other possibilities of introducing the possibly cold product, e.g. a dough, into a continuous foil tube and then to process this foil tube further using the process and the device in accordance with the invention.

Naturally, it is also possible to pack products in this manner in addition to food products, such as bath shampoo, grease and generally pasty substances which can be expelled in a foil tube.

Object of the present invention is not only the result of the object of the individual patent claims but also of the combination of individual patent claims. All features and characteristics disclosed in the documentation—including the summary—in particular the arrangement shown in the drawings are claimed as essential to the invention to the extent that jointly or severally they are new in terms of existing technology.

BRIEF DESCRIPTION OF THE DRAWINGS

The following is a more detailed description of the invention through drawings which illustrate only one variant. The drawings and their description disclose additional essential characteristics and advantages of the invention.

DESCRIPTION OF THE PREFERRED EMBODIMENT

Figure 1:
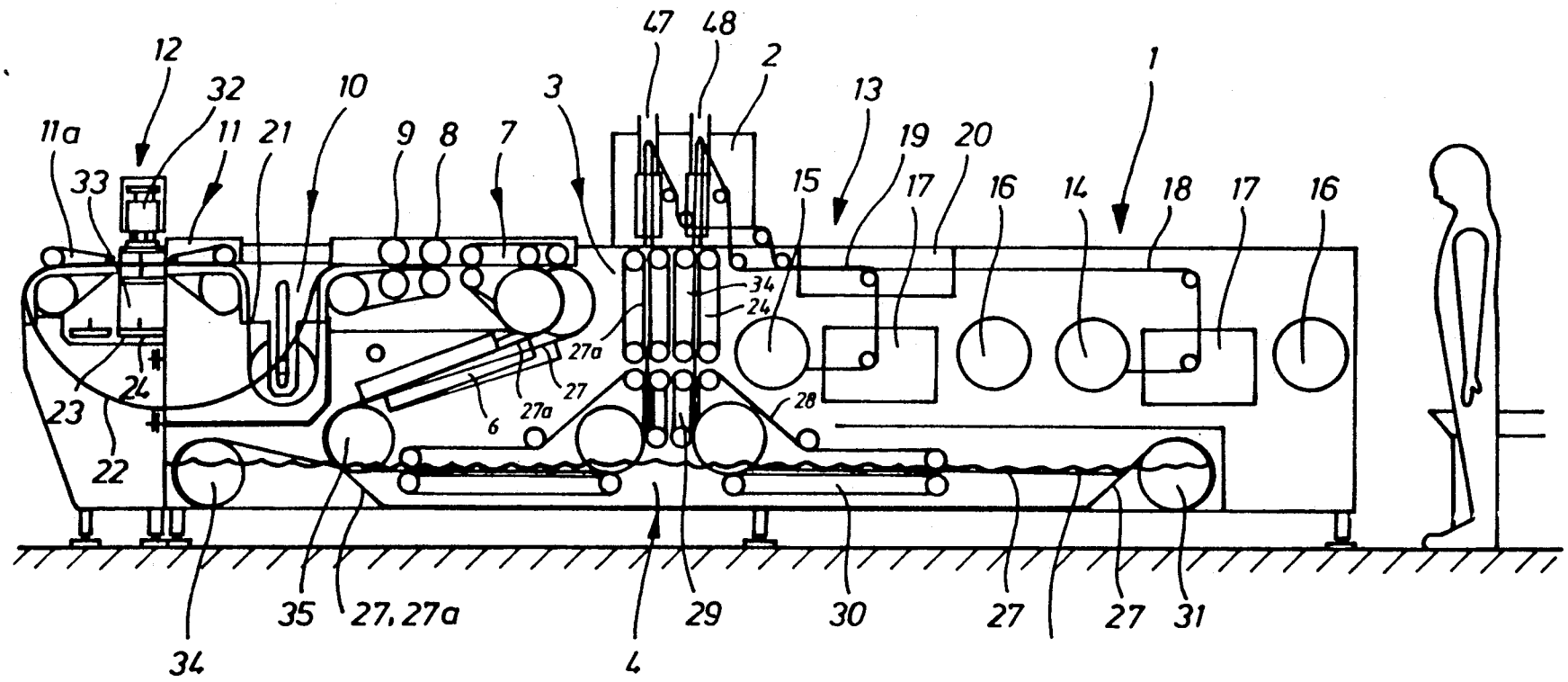
FIG. 1 is a lateral view of a machine to implement the process.

In essence, a device for implementing the process consists of a machine capable of processing two different food products as shown in the variant example and consequently filling, expelling, sealing and cutting two different foil tubes 27, 27*a*.

For reasons of clarity, the following describes only one process line because the other parallel process line is exactly identical.

In other words, in order to put into practice the philosophy of the present invention, it is sufficient to design the machine described hereafter with a single process line for processing a single foil tube, e.g. foil tube 27.

In essence, a foil feed station 1 consists of a foil roller 14 arranged in a so-called foil exchanger 17. This makes it possible to place a spare roller 16 in the foil exchanger 17 when the foil roller 4 is reeled off.

Similarly, this applies to the foil roller 15 of the second process line which is arranged in an identical foil exchanger 17 and which is assigned to an identical spare roller 16.

The foil paths 18, 19 of the two process lines are led through an alignment station 20 where the foil strand is aligned in order to obtain an exact formation of a foil tube in the following tube form station 2.

The tube form station 2 converts the previously flat foil path 18, 19 into an open foil tube. To this effect, the previously flat foil path 18, 19 is formed into a tube and sealed lengthwise thus resulting in the formation of the previously mentioned foil tube 27, 27*a*. The food product is then introduced into this open foil tube in the area of the tube form station 2.

After traveling through the tube form station the foil tube 27, 27*a* is now filled with the product to be packed and runs first through a form station 3 consisting of individual parallel belts 34 with a gap between them and between which runs the filled foil tube 27, 27*a*, which form a rectangular foil tube 27, 27*a* out of the foil tube previously made round or oval in the tube form station 2.

In accordance with the above description it is preferred to fill the tube form station with a hot meltable product which flows into a cooling station 4 after traversing the form station 3.

It is to be pointed out that the cooling station 4 as described hereafter need not necessarily consist of a water bath. Other cooling processes may also be taken into consideration, e.g. air cooling process, heat sink cooling on corresponding cooling disks and such.

The cooling station 4 as shown in the sample variant consists in essence of a hydrodynamic tank 5, in which a series of guide rollers are arranged so that the rectangular foil tube 27, 27*a* filled with the hot product is led back and forth several times in this hydrodynamic tank until the required cooling is reached.

As shown in the variant example, the foil tube when leaving the form station 3 is first led through an upper conveyer 28 consisting of parallel longitudinal belts 28, 29 which introduce the rectangular foil tube into the hydrodynamic tank. The foil tube 27, 27*a* then reaches the area of the upper longitudinal belt 28 located across from a lower horizontal conveyer 30 which ensures an additional guidance and formation of the foil tube during the cooling process.

The foil tube 27 is then led over the guide roller 31 in the form of an eight and along the bottom of the hydrodynamic tank 5 to another guide roller 35.

The other foil tube 27*a* is led in a similar manner around the guide rollers 31, 35, 36 so that both foil tubes 27, 27*a* lie over one another upon leaving the hydrodynamic tank 5 and in this arrangement are led through a dry section 6. Before the dry section 6 is a wiper which removes any remaining water from the hydrodynamic tank 5. Both foil tubes 27, 27*a* are then dried with air in the area of the dry section 6 whereby the air may be cold or hot.

Both foil tubes are then led over two parallel guide rollers and introduced into a transport station 7

The purpose of the transport station 7 is to drive the foil tube 27, 27*a* continuously and to introduce them into the subsequent expulsion station 8. The speed of the drive of the transport station 7 and of the drive in the form station 3 is synchronized.

Figure 4:
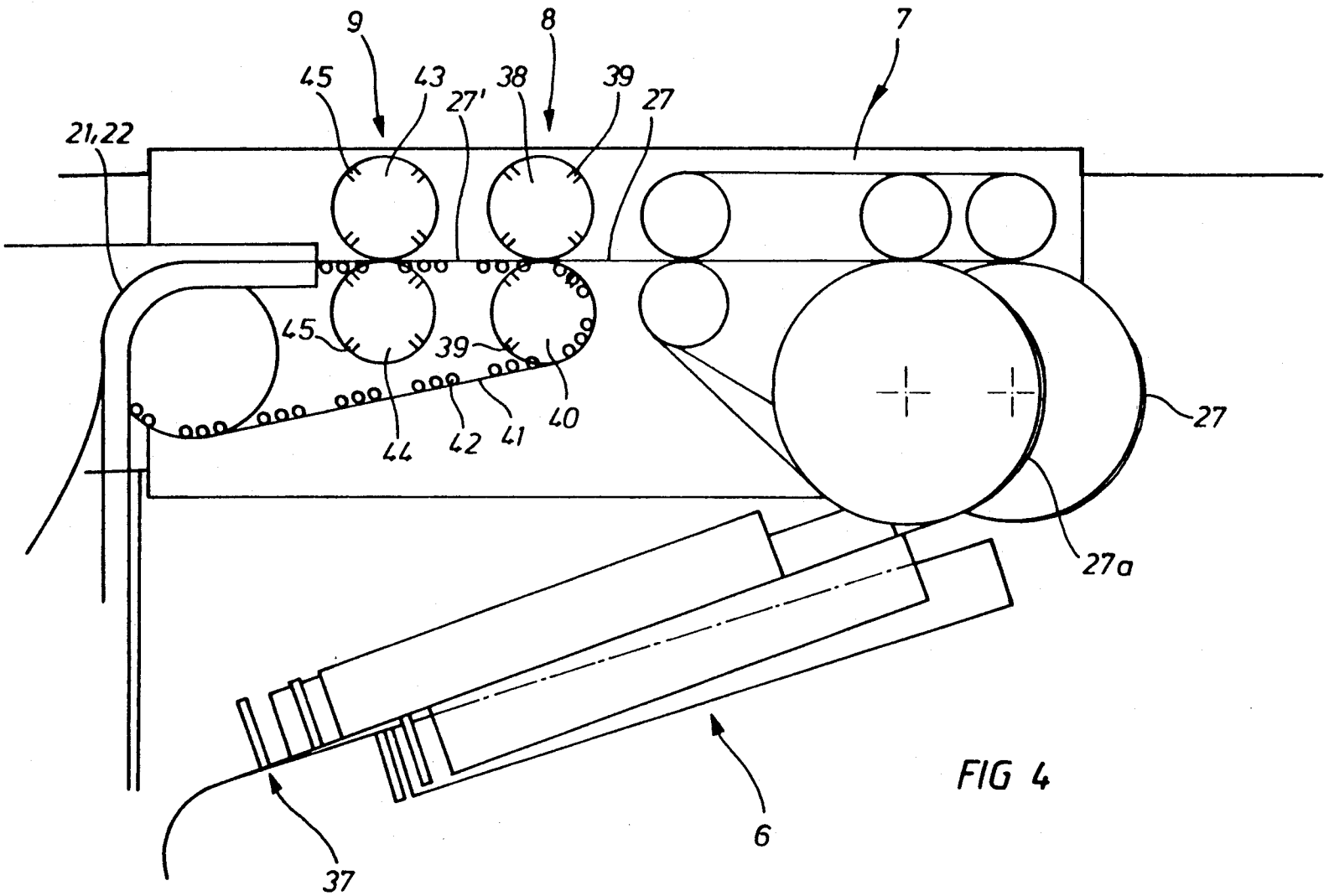
FIG. 4 illustrates a detail of the machine on the discharge end.

Details of the expulsion station 8 and the sealing station 9 are shown in FIG. 4.

Figure 2:
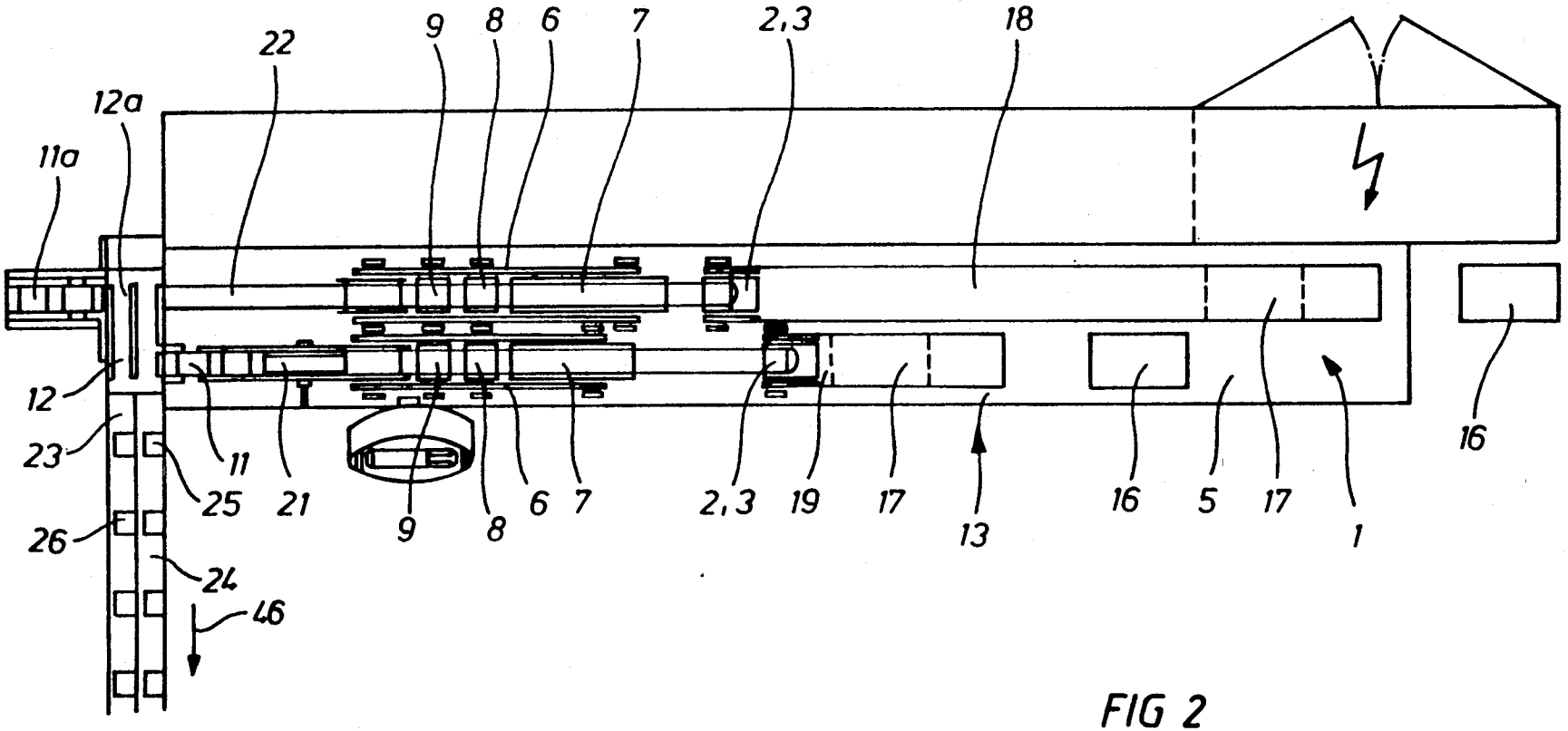
FIG. 2 is a top view of the machine in accordance with FIG. 1.

FIG. 2 shows that the foil tubes 27, 27*a* are introduced parallel to one another into the respective expulsion station 8 and the subsequent sealing station 9, i.e. each foil tube 27, 27*a* is assigned its own expulsion station 8 and an assigned sealing station 9.

FIG. 4 shows the two expulsion and sealing stations behind one another in the drawing plane whereby the front expulsion and sealing station is visible.

Therefore FIG. 4 describes only the processing of a single foil tube, e.g. foil tube 27.

After traveling through the transport station 7 in accordance with FIG. 4 the foil tube 27 reaches the area of the expulsion station 8.

The expulsion station consists in essence of an upper roller 38 with expulsion webs 39 located radially over the outer periphery and across from it a lower roller 40 over which is led a chain 41 or ratchet belt 41 with supporting webs 42.

As a result, the chain or ratchet belt 41 drives the roller 40.

As soon as the rectangular foil tube 27 filled with the cooled product reaches the area between the two rollers 38, 40, the expulsion webs 39 oriented radially outward expel the product inward and outward in a short narrow area extending over the width of the foil tube, i.e. in the longitudinal direction of the foil tube. The support webs 42 serve to support the chain or ratchet belt 41 so that the processed foil 27' does not sag between the expulsion station 8 and the sealing station 9. In addition, expulsion webs 39 which are also radially oriented outward are arranged in the area of the lower roller 40 whereby both rollers 38, 40 are synchronized so that an expulsion web 39 of the upper roller 38 strikes an expulsion web 39 of the lower roller 40, thus effecting the desired formation of the desired web for the foil tube.

The as yet unsealed foil tube 27' equipped with web-like separations now reaches the area of the sealing station 9 where once again there are two rollers located across from one another with radially outward oriented sealing webs 45 which are heated and as a result place the desired narrow sealing seam in the area of the previously expelled web. Both rollers 43, 44 are heated accordingly.

It is important that the sealing station 9 be arranged closely behind the expulsion station 8 to prevent the accidental opening of the previously separated webs in the foil tube by any product which may flow back, which would affect sealing quality. Indeed, the product is cooled off to the extent that it is in a viscous pasty state which delays a return flow of the product into the area of the separated web.

This makes it possible for the first time to obtain relatively narrow sealing seams with high sealing quality because in the area between the expulsion station 8 and the sealing station 9 no deformation is to be expected in the cooled off foil tube 27'. As a result, high sealing quality (tight sealing seam) can be ensured despite narrow sealing area.

After traveling through the sealing station 9, the now sealed foil strand reaches the area of a smoothing station 10 where both foil strands are divided into one longer smoothing loop 22 and a shorter smoothing loop 21, each consisting of individual sections of a foil tube which are contiguous but which are sealed off from one another whereby the individual divisions are filled with the product. Purpose of the smoothing station 10 is to transfer from a continuous transport of the transport station 7 to a cycled transport as used in the following cut and stacking unit 12. To this effect, there are foil transport stations 11*a* which assume this cycled transport. In other words, the smoothing loops 21, 22 form a sort of longitudinal buffer which ensures a cycled operation of the subsequent foil transport stations 11, 11*a*.

In the cutting and stacking unit 12 the individual sealed sections are cut in the respective foil tube, and the two different packagings from the separated foil tubes are stacked in a stacking tray 33 after they have been cut by the cutting device 32. The stacking tray 33 forms product stacks 25, 26 which are taken to a packing station by a conveyer belt 23, 24.

The above description describes two different product lines of the device in accordance with the invention. Obviously, integral part of the scope of the present invention is the use of only one product line or more than two product lines.

The use of two product lines offers the advantage that different products can be made with one and the same machine before being placed separate from each other on a conveyer belt 23, 24 where they can either be mixed and taken as a mix to a packing machine, or where they are taken separately from each other to the subsequent packing machine.

In the variant example shown the product stacks 25, 26 already consist of different products because in the cutting and stacking unit 12 arranged behind one another, for example five packed slices of one food product are placed on the conveyer belt 23 , and five other slices of the other product are also placed on this product stack on the conveyer belt 23 by the other cutting and stacking unit whereby each time mixed product stacks 25, 26 are carried off on the conveyer belt 23, 24 in the direction of travel 46.

Figure 3:
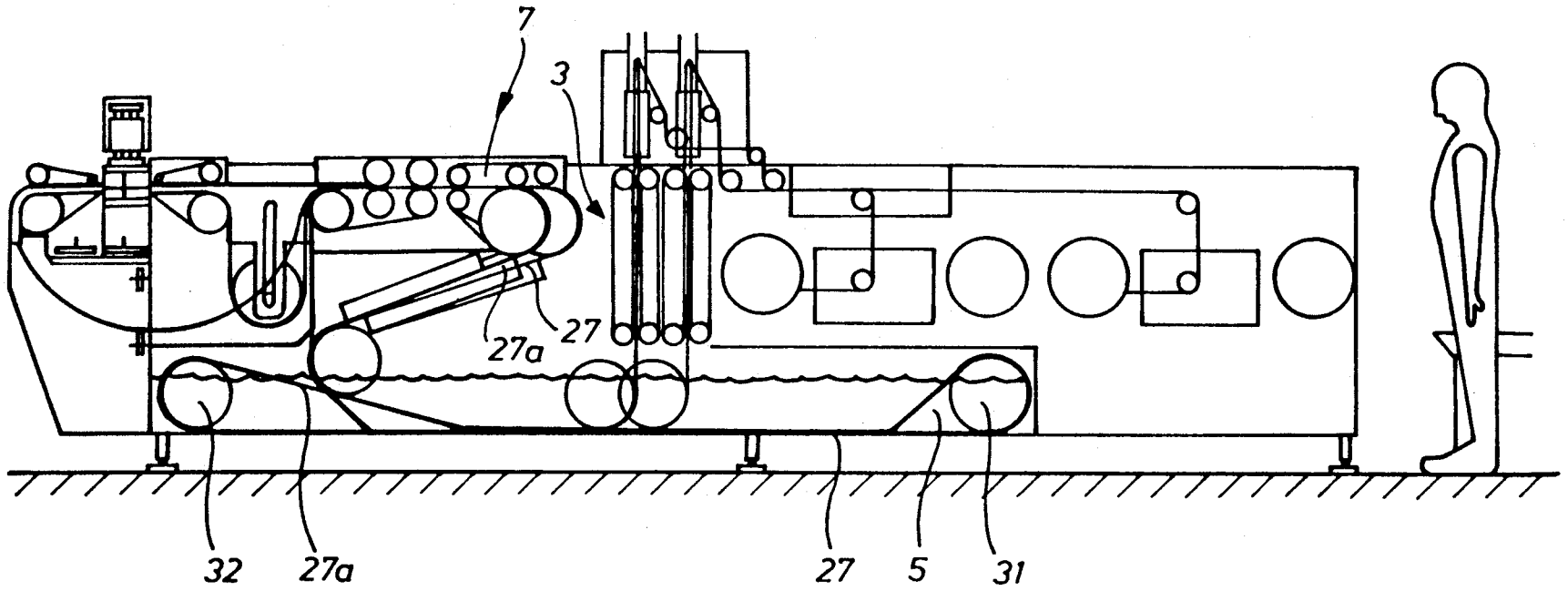
FIG. 3 is a lateral view similar to FIG. 1 illustrating a modified machine.

It is to be noted that FIG. 3 shows a simplified version compared to FIG. 1 without formation belts 28, 29, 30 and with simplified cooling. Otherwise, the same references apply to the same parts.

We claim:

1. A process for packing a liquid, semi-liquid, soft or fine-powder product in a closed continuous foil tube, comprising the steps of:

transporting a continuous foil tube having opposite longitudinal sides forwardly through a series of processing stations from a tube form station through a cooling station, an expulsion station and a sealing station spaced from the expulsion station;

introducing the product into the foil tube in the area of the tube form station;

cooling off the product being filled into the foil tube to a final product temperature in the cooling station;

expelling the cooled product from web-like expulsion areas extending over the width of the foil tube in the expulsion station; and forming hermetic sealing seams at the expulsion areas extending from one longitudinal side to the other longitudinal side of the foil tube in the sealing station.

2. An apparatus for packing a liquid, semi-liquid, soft or fine-powder product in a closed continuous foil tube, comprising:

a tube forming station having means for wrapping a flat foil into a tube and sealing the overlapping edges of the foil to form a continuous longitudinal seal;

feed means for feeding a product in a hot molten state into the tube at the tube forming station;

transport means for transporting the filled tube from the tube forming station along a processing path through a series of processing stations including a cooling station, an expulsion station an a sealing station;

the cooling station being situated after the tube forming station and having cooling means for cooling the product in the tube to a final product temperature:

the expulsion station being situated after the cooling station and comprising expulsion means for expelling the product from web-like expulsion areas extending across the width of the tube at spaced intervals along the length of the tube; and the sealing station being situated after the expulsion station and comprising sealing means for forming hermetic sealing means at the expulsion areas extending from one longitudinal side to the other longitudinal side of the foil tube.

3. Apparatus as claimed in claim 2, wherein the cooling station comprises a hydrodynamic tank.

4. Apparatus as claimed in claim 2, wherein the cooling station comprises an air cooling or heat sink device.

5. Apparatus as claimed in claim 2, further including opposing conveyor belts in the area of the cooling station for changing the form of the foil tube.

6. Apparatus as claimed in claim 2, further including a drying station arranged at the discharge end of the cooling station prior to the expulsion station.

7. Apparatus as claimed in claim 2, including two parallel, identical processing paths each including the same sequence of processing stations for forming two packed foil tubes simultaneously.

* * * * *